US009202650B2

(12) United States Patent
Merrifield et al.

(10) Patent No.: US 9,202,650 B2
(45) Date of Patent: Dec. 1, 2015

(54) QUICK DISCONNECT CONNECTOR ASSEMBLY

(71) Applicant: General Equipment and Manufacturing Company, Inc., Louisville, KY (US)

(72) Inventors: Gregory Curtis Merrifield, Prospect, KY (US); Robert Lynn LaFountain, Charlestown, IN (US)

(73) Assignee: General Equipment and Manufacturing Company, Inc., Louisville, KY (US)

( * ) Notice: Subject to any disclaimer, the term of this patent is extended or adjusted under 35 U.S.C. 154(b) by 0 days.

(21) Appl. No.: 13/802,150

(22) Filed: Mar. 13, 2013

(65) Prior Publication Data

US 2014/0261794 A1 Sep. 18, 2014

(51) Int. Cl.

| | |
|---|---|
| ***H01H 9/00*** | (2006.01) |
| ***H01H 36/00*** | (2006.01) |
| ***H01R 13/703*** | (2006.01) |
| ***H01H 36/02*** | (2006.01) |

(52) U.S. Cl.

CPC ..... *H01H 36/0073* (2013.01); *H01H 36/008* (2013.01); *H01H 36/0033* (2013.01); *H01H 36/02* (2013.01); *H01R 13/7037* (2013.01); *Y10T 137/8242* (2015.04)

(58) Field of Classification Search

CPC ..... H01H 36/00; H01H 9/00; H01R 13/66; F16K 31/02; G06F 19/00; G01B 5/28; F01B 31/00; G01F 1/38

USPC ..... 335/205

See application file for complete search history.

(56) References Cited

U.S. PATENT DOCUMENTS

| | | | | |
|---|---|---|---|---|
| 2,399,938 | A * | 5/1946 | Pett | 137/487 |
| 4,071,725 | A | 1/1978 | Smith et al. | |
| 4,109,988 | A * | 8/1978 | Olson | 439/265 |
| 4,117,431 | A * | 9/1978 | Eicher | 335/207 |
| 4,674,338 | A * | 6/1987 | Carpenter | 73/861.77 |
| 4,837,539 | A * | 6/1989 | Baker | 335/207 |
| 5,554,049 | A * | 9/1996 | Reynolds | 439/490 |
| 6,127,910 | A | 10/2000 | Webb et al. | |
| 8,036,837 | B2 * | 10/2011 | Wilke | 702/35 |
| 8,362,859 | B2 * | 1/2013 | Pearce et al. | 335/205 |

(Continued)

OTHER PUBLICATIONS

International Search Report and Written Opinion, corresponding International Application No. PCT/US2014/027857, mailed Jul. 3, 2014.

*Primary Examiner* — Shawki S Ismail
*Assistant Examiner* — Lisa Homza
(74) *Attorney, Agent, or Firm* — Marshall, Gerstein & Borun LLP

(57) ABSTRACT

A quick-disconnect connector assembly includes a housing having a bore that extends up to but not through a first end of the housing. The connector assembly also includes a proximity switch disposed within the bore, and the proximity switch includes a switch body, a first contact member, and a second contact member. A portion of each of the first and second contact members extends from the switch body towards a second end of the housing. In a first switch position, a contact of a displaceable switching assembly is in contact with the first contact member, and in a second switch position, the contact is in contact with the second contact member. The connector assembly also includes an external connection assembly including a first pin that is electrically coupled to the first contact member and a second pin that is electrically coupled to the second contact member.

20 Claims, 11 Drawing Sheets

(56) References Cited

U.S. PATENT DOCUMENTS

| | | | | |
|---|---|---|---|---|
| 8,400,241 | B2 * | 3/2013 | Simmons | 335/205 |
| 2002/0149454 | A1 * | 10/2002 | Nishikawa | 335/205 |
| 2008/0266035 | A1 * | 10/2008 | Rohrig et al. | 335/205 |
| 2009/0222220 | A1 * | 9/2009 | Wilke | 702/34 |
| 2011/0001070 | A1 * | 1/2011 | Wilke | 251/129.03 |
| 2012/0007702 | A1 * | 1/2012 | Pearce et al. | 335/207 |
| 2012/0029848 | A1 * | 2/2012 | Wilke | 702/51 |
| 2012/0206224 | A1 | 8/2012 | Simmons | |

* cited by examiner

QUICK DISCONNECT CONNECTOR ASSEMBLY

FIELD OF THE DISCLOSURE

This disclosure relates generally to proximity switches, and, more particularly, to a housing for a miniature magnetically-triggered proximity switch.

BACKGROUND

Magnetic proximity switches, also known as limit switches, are commonly used for position sensing. Typically, magnetically-triggered proximity switches include a sensor that is adapted to detect the presence of a target without physically contacting the target. Typically, the sensor may include a switching circuit mechanism enclosed within a switch body, and the switching circuit mechanism typically includes multiple levers and contacts that are biased into a first position by one or more springs. When the target, which generally includes a permanent magnet contained within a housing, passes within a predetermined range of the sensor, the magnetic flux generated by the target magnet triggers the switching circuit mechanism, thereby closing a normally open circuit. The closing of the normally open circuit is detected by a processor, and a signal is sent to an operator or an automated operation system to indicate the presence of the target within the predetermined range of the sensor. The target is typically secured to a displaceable element of a system, such as a valve stem, and the sensor is typically secured to a stationary element of a system, such as a valve body. When so configured, the sensor can detect when the displaceable element has changed positions.

Typically, the sensor is disposed within or secured to a durable housing to protect the sensor. A connector socket assembly is coupled to the sensor housing (by a welding operation, for example) and the connector socket assembly includes a field side connector. However, due to the relatively large physical size of the sensor necessary to enclose the switching circuit mechanism, typical sensor housings are relatively large and cannot be used in applications requiring the placement of the sensor in an area having limited free space. In addition, the need to provide power to the sensor also limits the applications in which the sensor can be used.

While a relatively small magnetically-triggered proximity switch (and a correspondingly smaller housing) may be desirable, the ability to reduce the size of the proximity switch may be limited by several factors. Specifically, if relatively high load values are required in addition to programmable logic controller ("PLC") level loads of about 5V, correspondingly large contacts are necessary to accommodate the greater loads, and these large contacts limit the ability of the switch to be reduced in size. Additionally, as previously explained, there are numerous components that are disposed within the switch housing, and the size of the relatively complex actuation assembly limits the minimum size of the switch. Such a complex actuation assembly also adds time and cost to the manufacturing of the proximity switch.

BRIEF SUMMARY OF THE DISCLOSURE

In accordance with one exemplary aspect of the present invention, a quick-disconnect connector assembly includes a housing that extends along a longitudinal axis from a first end to a longitudinally-opposite second end. The housing includes one or more interior surfaces that cooperate to define a bore that extends from the second end to a point adjacent to the first end such that the bore does not extend through the first end of the housing, with the bore including a first bore portion. The quick-disconnect connector assembly also includes a proximity switch disposed within the first bore portion, the proximity switch including a switch body extending along a body longitudinal axis. The switch body has a first end disposed adjacent to the first end of the housing and a longitudinally-opposite second end. The proximity switch also includes a first contact member and a second contact member, and each of the first and second contact members has a first end and a longitudinally-opposite second end, with the second end being disposed within the switch body and the first end being disposed external to the switch body. A portion of each of the first and second contact members extends from the second end of the switch body towards the second end of the housing. In a first switch position, a contact of a displaceable switching assembly is in contact with a portion of the first contact member, and in a second switch position, the contact of the switching assembly is in contact with a portion of the second contact member. The quick-disconnect connector assembly also includes an external connection assembly including a first pin that is electrically coupled to the first contact member and a second pin that is electrically coupled to the second contact member. The first pin and the second pin each extend in a longitudinal direction, and at least a portion of each of the first pin and the second pin are disposed within the bore.

In accordance with another exemplary aspect of the present invention, a system for detecting a position of a control valve includes a valve housing including an inlet, an outlet, and a valve seat disposed between the inlet and the outlet. A displaceable valve member is disposed at least partially within the valve housing, and the valve member is displaceable between a closed position in which the valve member sealingly engages the valve seat and an open position in which the valve member is positioned away from the valve seat. The system further includes a magnetic target coupled to the valve member. In addition, the system includes a quick-disconnect connector assembly fixed relative to the valve member, and the quick-disconnect connector assembly has a housing that extends along a longitudinal axis from a first end to a longitudinally-opposite second end. The housing includes one or more interior surfaces that cooperate to define a bore that extends from the second end to a point adjacent to the first end such that the bore does not extend through the first end of the housing, with the bore including a first bore portion. The quick-disconnect connector assembly also includes a proximity switch disposed within the first bore portion, the proximity switch including a switch body extending along a body longitudinal axis. The switch body has a first end disposed adjacent to the first end of the housing and a longitudinally-opposite second end. The proximity switch also includes a first contact member and a second contact member, and each of the first and second contact members has a first end and a longitudinally-opposite second end, with the second end being disposed within the switch body and the first end being disposed external to the switch body. A portion of each of the first and second contact members extends from the second end of the switch body towards the second end of the housing. In a first switch position, a contact of a displaceable switching assembly is in contact with a portion of the first contact member, and in a second switch position, the contact of the switching assembly is in contact with a portion of the second contact member. The quick-disconnect connector assembly also includes an external connection assembly including a first pin that is electrically coupled to the first contact member and a second pin that is electrically coupled to the second contact member. The first pin and the second pin each extend in a longitudinal direction, and at least a portion of each of the first pin and the second pin are disposed within the bore. The system further includes a controller operatively coupled to the first pin and the second pin.

DETAILED DESCRIPTION

Figure 1A:
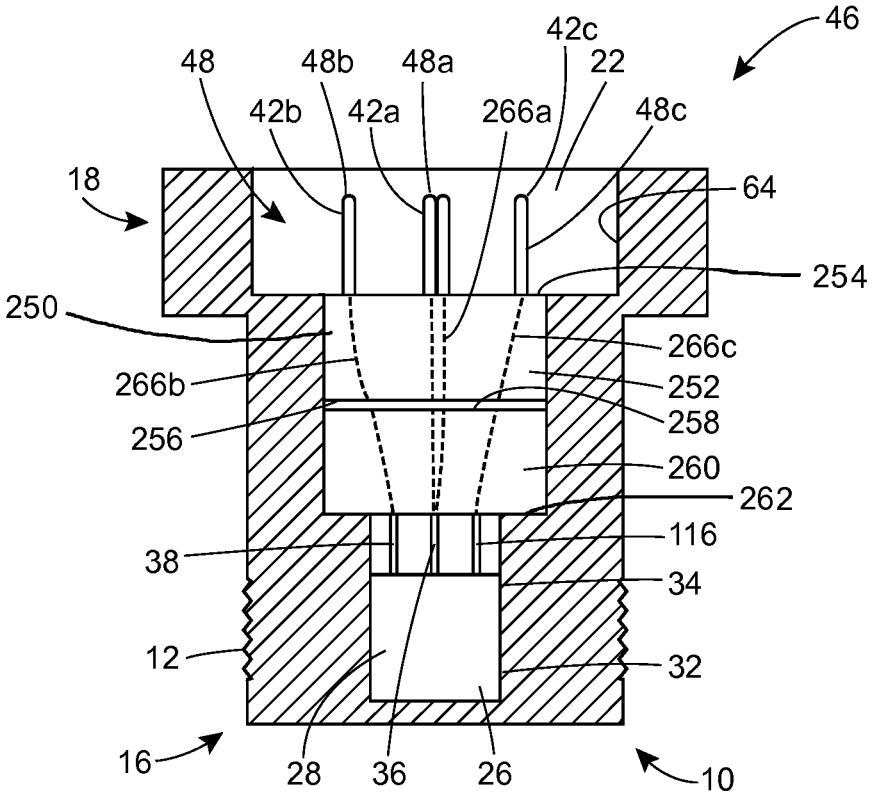
FIG. 1A is a side cross-sectional view of an embodiment of a quick-disconnect connector assembly.
Figure 2:
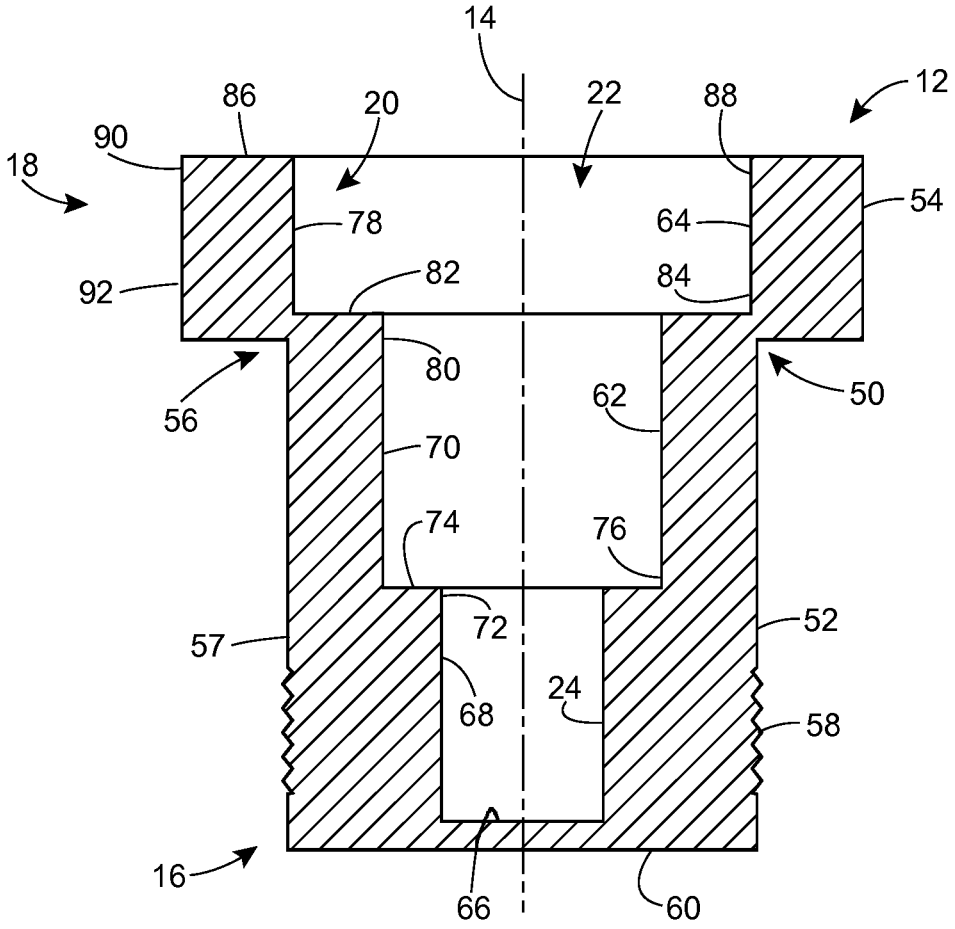
FIG. 2 is a side cross-sectional view of a housing of the quick-disconnect connector assembly of FIG. 1A.
Figure 3A:
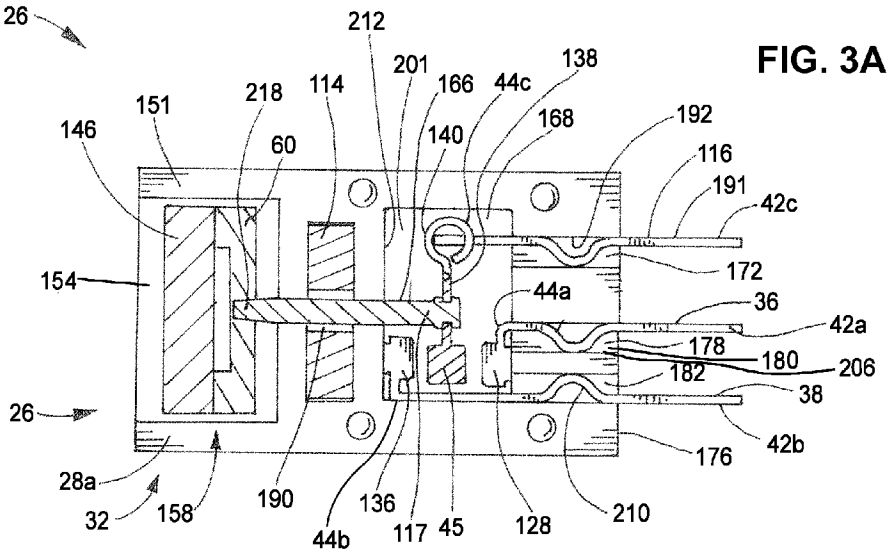
FIG. 3A is a top semi-sectional view of an embodiment of a proximity switch of the quick-disconnect connector assembly of FIG. 1A.
Figure 8A:
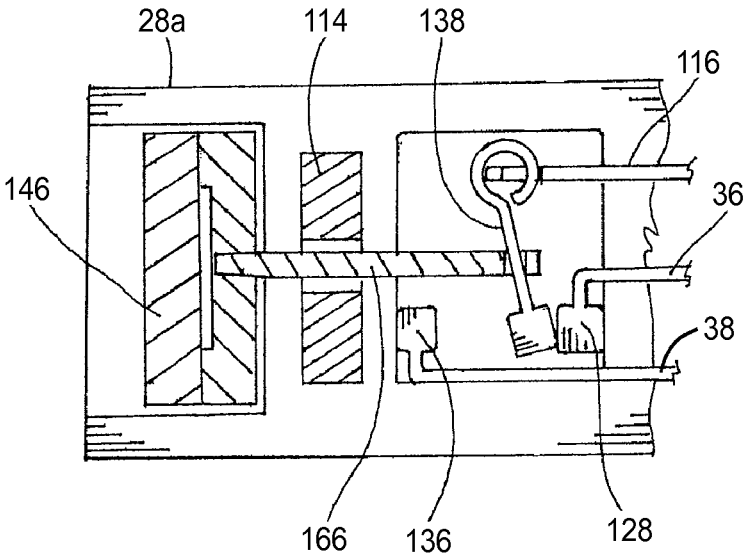
FIG. 8A is semi-sectional view of an embodiment of a magnetically-triggered proximity switch in a first switch position.
Figure 8B:
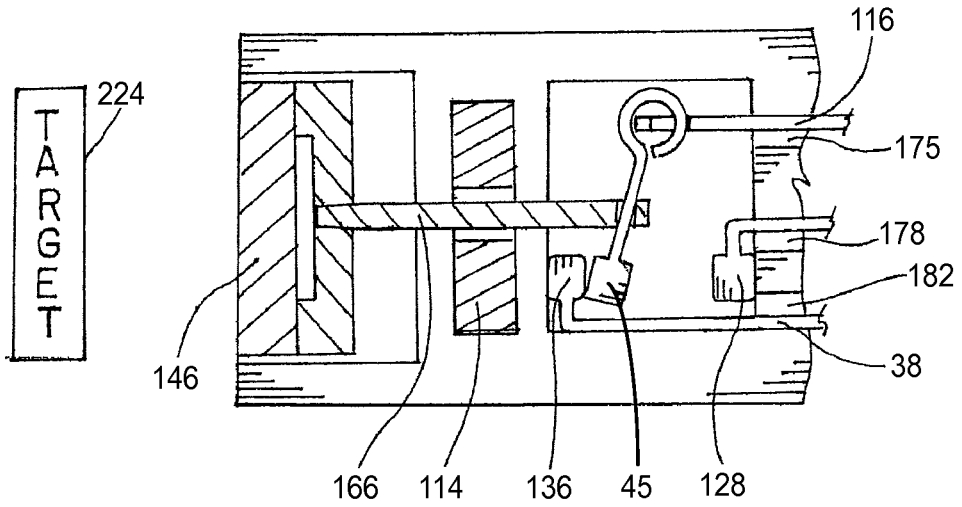
FIG. 8B is semi-sectional view of an embodiment of a magnetically-triggered proximity switch in a second switch position.

As illustrated in FIG. 1A, a quick-disconnect connector assembly 10 includes a housing 12 that extends along a longitudinal axis 14 (illustrated in FIG. 2) from a first end 16 to a longitudinally-opposite second end 18. Referring to FIG. 2, the housing 12 includes one or more interior surfaces 20 that cooperate to define a bore 22 that extends from the second end 18 to a point adjacent to the first end 16 such that the bore 22 does not extend through the first end 16 of the housing 12, with the bore 22 including a first bore portion 24. Turning to FIG. 1A, the quick-disconnect connector assembly 10 also includes a proximity switch 26 disposed within the first bore portion 24. The proximity switch 26 includes a switch body 28 extending along a body longitudinal axis 30 (illustrated in FIG. 6), and the switch body 28 has a first end 32 disposed adjacent to the first end 16 of the housing 12 and a longitudinally-opposite second end 34. As illustrated in FIG. 3A, the proximity switch 26 also includes a first contact member 36 and a second contact member 38, each of the first and second contact members 36, 38 having a first end 42*a*, 42*b* and a longitudinally-opposite second end 44*a*, 44*b*. The second end 44*a*, 44*b* is disposed within the switch body 28 and the first end 42*a*, 42*b* is disposed external to the switch body 28. As illustrated in FIG. 1A, a portion of each of the first and second contact members 36, 38 extends from the second end 34 of the switch body towards the second end 18 of the housing 12. In a first switch position (illustrated in FIG. 8A), a contact (such as a common contact 45) of a displaceable switching assembly 47 is in contact with a portion of the first contact member 36, and in a second switch position (illustrated in FIG. 8B), the contact of the switching assembly 47 is in contact with a portion of the second contact member 38.

Referring to FIG. 1A, the quick-disconnect connector assembly 10 also includes external connection assembly 46 including a first pin 48*a* that is electrically coupled to the first contact member 36 and a second pin 48*b* that is electrically coupled to the second contact member 38. The first pin 48*a* and the second pin 48*b* each extend in a longitudinal direction, and at least a portion of each of the first pin 48*a* and the second pin 48*b* are disposed within the bore 22. So configured, the quick-disconnect connector assembly 10 provides a sealed, easily installable component that eliminates the use of a separate housing for the proximity switch 26. In addition, the magnetically-triggered proximity switch 26 is permanently disposed within (i.e., is integral to) the housing 12, and the proximity switch 26 uses relatively few moving parts, allowing for a compact size of the proximity switch 26 and, as a result, the quick-disconnect connector assembly 10. Moreover, because the proximity switch uses magnetic forces to switch from the first switch position to the second switch position (and vice versa), no external power source is necessary.

Turning to the quick-disconnect connector assembly 10 in more detail, the housing 12, as illustrated in FIG. 2, extends along the longitudinal axis 14 from the first end 16 to the second end 18 that is longitudinally-opposite the first end, as illustrated in FIG. 1A a. The housing 12 may include an intermediate point 50 disposed between the first end 16 and the second end 18, and the housing 12 may include a first exterior portion 52 that extends from the first end 16 to the intermediate point 50 and a second exterior portion 54 that extends from the intermediate point 50 to the second end 18. The first exterior portion 52 and the second exterior portion 54 may have any suitable shape or combination of shapes. For example, the first exterior portion 52 and the second exterior portion 54 may each be cylindrical (i.e., may each have a circular cross sectional shape when viewed along the longitudinal axis). A diameter of the second exterior portion 54 (i.e., a diameter of the circular cross-sectional shape of the second exterior portion 54) may be larger than a diameter of the first exterior portion 52 (i.e., a diameter of the circular cross-sectional shape of the first exterior portion 52), thereby forming a shoulder portion 56 at the intermediate point 50. Alternatively, a diameter of the second exterior portion 54 may be smaller than or equal to a diameter of the first exterior portion 52. A portion of a first exterior surface 57 of the first exterior portion 52 may be threaded, and the threaded portion 58 may be disposed adjacent to the first end 16 of the housing 12. More particularly, the threaded portion 58 may extend from a point at the first end 16 of the housing 12 to a point midway between to the first end 16 of the housing 12 and the shoulder portion 56. An end surface 60 may be disposed at the first end 16 of the housing 12, and the end surface 60 may have any suitable shape or combination of shapes. For example, the end surface 60 may be normal or substantially normal to the longitudinal axis 14, and the end surface 60 may be planar or substantially planar. Alternatively, the end surface 60 may be conical, frustoconical, rounded, partially tapered, and/or partially rounded.

Still referring to FIG. 2, the housing 12 includes one or more interior surfaces 20 that cooperate to define the bore 22 that extends from the open second end 18 of the housing 12 to a point adjacent to the closed first end 16 of the housing 12 such the bore 22 does not extend through the first end 16 of the housing 12. The bore 22 may be any suitable shape or combination of shapes. For example, the bore 22 may include the first bore portion 24, a second bore portion 62, and a third bore portion 64. The first bore portion 24 may longitudinally extend from a point adjacent to the first end 16 of the housing 12 towards the second end 18 of the housing 12, and the first bore portion 24 may be defined by a bottom bore surface 66 and a first interior wall 68. The bottom bore surface 66 may be disposed adjacent to the first end 16 of the housing 12, and the bottom bore surface 66 may be longitudinally offset from the end surface 60. The bottom bore surface 66 and the end surface 60 may be longitudinally-offset by any suitable distance. For example, the longitudinal distance between the bottom bore surface 66 and the end surface 60 may be between 3% and 10% of the overall longitudinal length of the housing 12. The bottom bore surface 66 may have any suitable shape or combination of shapes. For example, the bottom bore surface 66 may be normal or substantially normal to the longitudinal axis 14, and the bottom bore surface 66 may be planar or substantially planar. Alternatively, the bottom bore surface 66 may be conical, frustoconical, rounded, partially tapered, and/or partially rounded. The bottom bore surface 66 and the end surface 60 may be imperforate—that is, no holes or passages extend between the bottom bore surface 66 and the end surface 60.

Referring again to FIG. 2, the first interior wall 68 may upwardly extend from a point adjacent to the closed first end 16 of the housing 12. For example, the first interior wall 68 may upwardly extend from a perimeter edge of the bottom bore surface 66 towards the second end 18 of the housing 12. The first interior wall 68 may have any suitable shape or combination of shapes, such as a cylindrical shape (i.e., having a circular cross sectional shape when viewed along the longitudinal axis). Alternatively, the first interior wall 68 may have the cross-sectional shape of an oval, a polygon, or a partial polygon.

Referring again to FIG. 2, the bore 22 may include the second bore portion 62, and the second bore portion 62 may be disposed between the first bore portion 24 and the third bore portion 64. The second bore portion 62 may be defined by a longitudinal second interior wall 70 that may upwardly extend from a point adjacent to a top end 72 of the first interior wall 68 to a point adjacent to the intermediate point 50 of the housing 12. The second interior wall 70 may have any suitable shape or combination of shapes, such as a cylindrical shape. A diameter of the second interior wall 70 (i.e., a diameter of the circular cross-sectional shape of the second interior wall 70) may be larger than a diameter of the first interior wall 68 (i.e., a diameter of the circular cross-sectional shape of the first interior wall 68), thereby forming a shoulder portion 74 that radially extends from the top end 72 of the first interior wall 68 to a bottom end 76 of the second interior wall 70. Alternatively, a diameter of the second interior wall 70 may be smaller than or equal to a diameter of the first interior wall 68. Instead of a circular cross-sectional shape, the second interior wall 70 may have the cross-sectional shape of an oval, a polygon, and/or a partial polygon, for example.

Referring once more to FIG. 2, the bore 22 may include the third bore portion 64, and the third bore portion 64 may be disposed between the second bore portion 62 and the second end 18 of the housing 12. The third bore portion 64 may be defined by a longitudinal third interior wall 78 that may upwardly extend from a point adjacent to a top end 80 of the second interior wall 70 to the second end 18 of the housing 12. The third interior wall 78 may have any suitable shape or combination of shapes, such as a cylindrical shape. A diameter of the third interior wall 78 (i.e., a diameter of the circular cross-sectional shape of the third interior wall 78) may be larger than a diameter of the second interior wall 70 (i.e., a diameter of the circular cross-sectional shape of the second interior wall 70), thereby forming a shoulder portion 82 that radially extends from the top end 80 of the second interior wall 70 to a bottom end 84 of the third interior wall 78. Alternatively, a diameter of the third interior wall 78 may be smaller than or equal to a diameter of the second interior wall 70. Instead of a circular cross-sectional shape, the third interior wall 78 may have the cross-sectional shape of an oval, a polygon, and/or a partial polygon, for example.

Figure 9A:
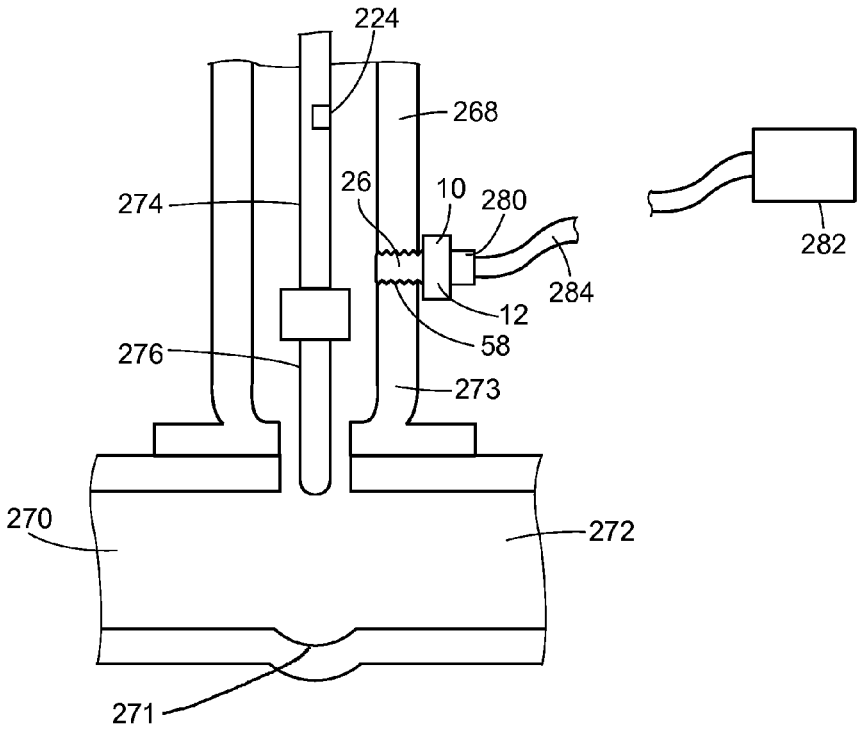
FIG. 9A is an embodiment of a control valve in a first position.
Figure 9B:
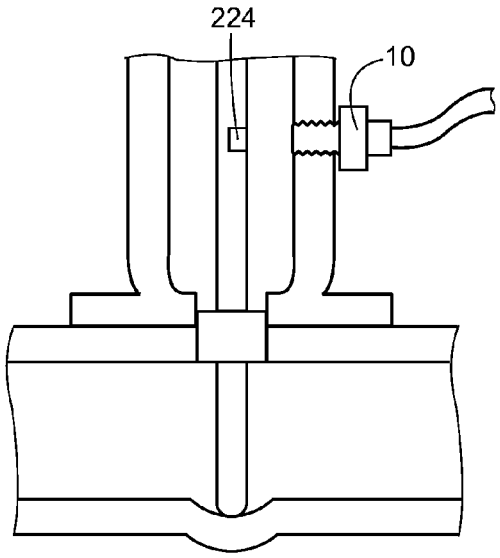
FIG. 9B is the embodiment of the control valve in a second position.

A portion of a second exterior surface 92 of the second exterior portion 54 or a portion of the third interior wall 78 may include one or more features that allow the second end 18 of the housing 12 to mate with or be removably coupled to a standard female plug 280 (illustrated in FIGS. 9A and 9B). For example, a portion of the second exterior surface 92 of the second exterior portion 54 may be threaded. Additionally, one or more slots (not shown) may extend through the second exterior surface 92 to the third interior wall 78, and the one or more slots may be adapted to provide for a bayonet connection between the plug 280 and the second end 18 of the housing 12. Additionally, a longitudinal planar surface 93 (illustrated in FIG. 1B) may be disposed within the third bore portion 64, and the planar surface 93 may be adapted to prevent relative rotation between the plug 280 and the housing 12.

Referring to FIG. 2, the housing 12 may also include an end wall 86 that radially extends from a top end 88 of the third interior wall 78 to a top end 90 of the second exterior surface 92 of the second exterior portion 54 of the housing 12. The end wall 86 may have any suitable shape or combination of shapes. For example, the end wall 86 may be normal or substantially normal to the longitudinal axis 14, and the end wall 86 may be planar or substantially planar. Alternatively, the end wall 86 may be conical, frustoconical, rounded, partially tapered, and/or partially rounded. The housing 12 may be made or a non-magnetic material, such as aluminum or plastic, for example. The material may be a high-temperature material that allows the housing 12 to be exposed to high and/or low temperature environments. The housing 12 may be a single, unitary part, or may be an assembly of two or more parts that are secured together to form the housing 12.

Figure 3C:
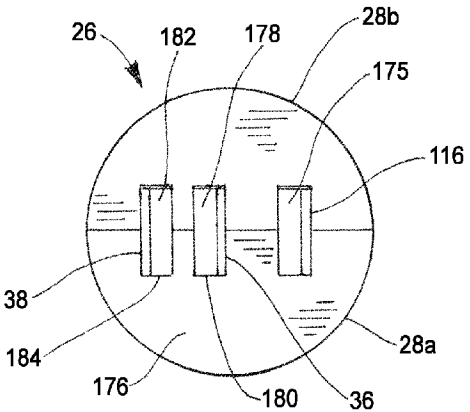
FIG. 3C is a rear view of the embodiment of FIG. 3A.
Figure 3B:
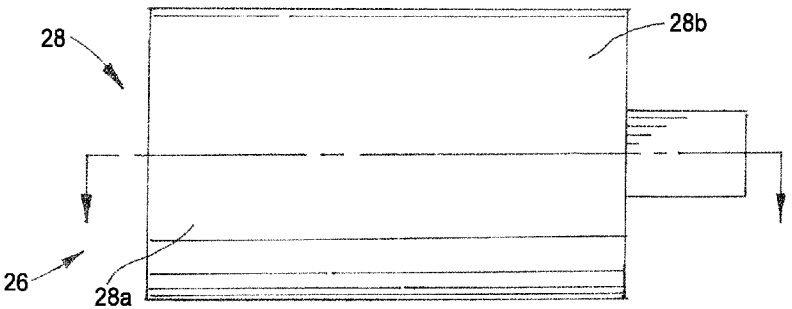
FIG. 3B is a side view of the embodiment of FIG. 3A.
Figure 5:
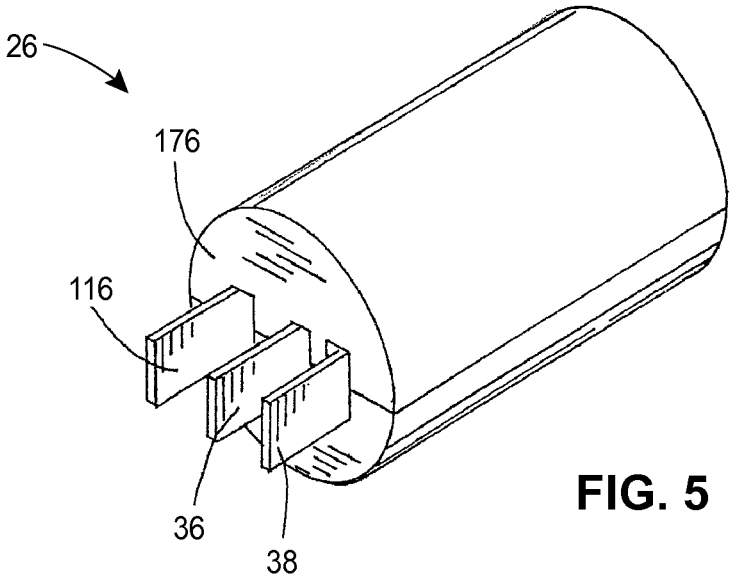
FIG. 5 is perspective view of an embodiment of a magnetically-triggered proximity switch.

As illustrated in FIG. 1A, the quick-disconnect connector assembly 10 also includes the proximity switch 26 disposed within the first bore portion 24 of the housing 12 such that the proximity switch 26 is integral with the housing 12. FIG. 3A shows a cross-sectional view of the switch body 28 (illustrated in FIG. 3B) of the magnetically-triggered proximity switch 10. The switch body 28 preferably has a generally cylindrical shape having a circular cross-section. However, the switch body 28 may have any cross-sectional shape, such as a polygon or an oval, for example. The switch body 28 may include a first body half 28*a* and a second body half 28*b* (illustrated in FIGS. 3A and 3C). Because the second body half 28*b* may be identical to the first body half 28*a*, only the first body half 28*a* is illustrated. Each of the first body half 28*a* and the second body half 28*b* may be formed from plastic and may be manufactured using conventional processes, such as injection-molding, for example. The plastic may be a high-temperature material that allows the switch body 28 to be exposed to environments that may damage conventional plastic materials. The first body half 28*a* and the second body half 28*b* may be joined into a single switch body 28, as illustrated in FIGS. 3B, 3C and 5, using any of several methods known in the art, such as ultrasonic welding or by using an adhesive. Additionally, the switch body 28 may be hermetically sealed to protect the proximity switch from water or dirt particles. However, the switch body 28 may be made of any suitable material and may be manufactured by any means known in the art.

Figure 6:
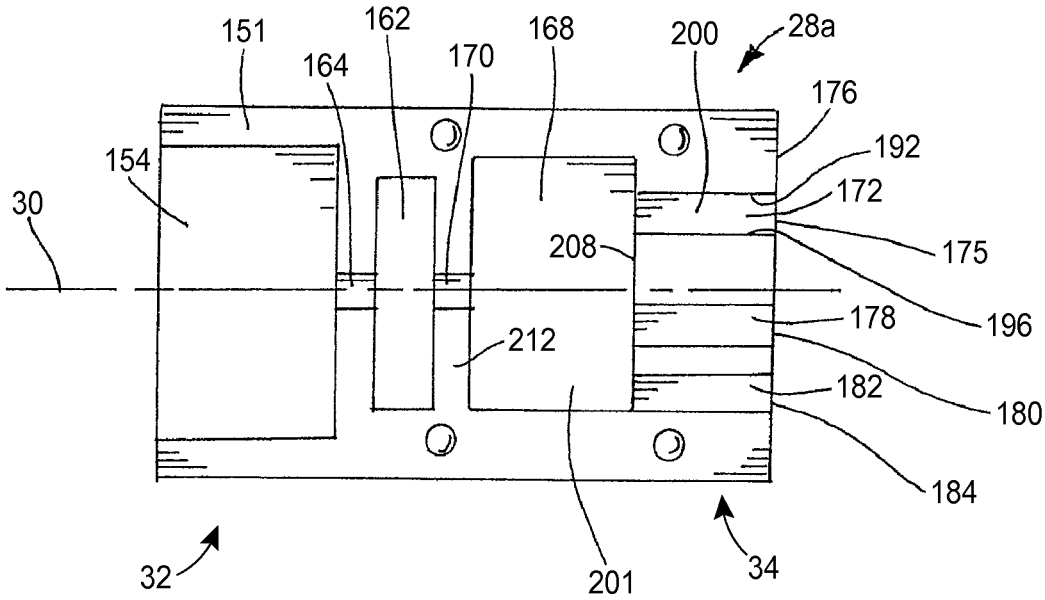
FIG. 6 is top view of a first body half of an embodiment of a magnetically-triggered proximity switch.

As illustrated in FIGS. 3A and 6, the semi-cylindrical first body half 28*a* of the switch body 28 may have a substantially planar mating surface 151 that is adapted to engage a corresponding mating surface (not shown) of the second body half 28*b* to form the switch body 28. As illustrated in FIG. 6, the first body half 28*a* also includes the open first end 32 that includes a semi-cylindrical second magnet cavity 154, and the second magnet cavity 154 may inwardly extend along the body longitudinal axis 30 that extends along the plane of the mating surface 151. The second magnet cavity 154 may be sized to receive a detector magnet assembly 158, illustrated in FIG. 4, that includes a disk-shaped second magnet 146 and a magnet base 160 coupled to the second magnet 146, and the detector magnet assembly 158 may slidably displace within the second magnet cavity 154 along the body longitudinal axis 30.

Figure 4:
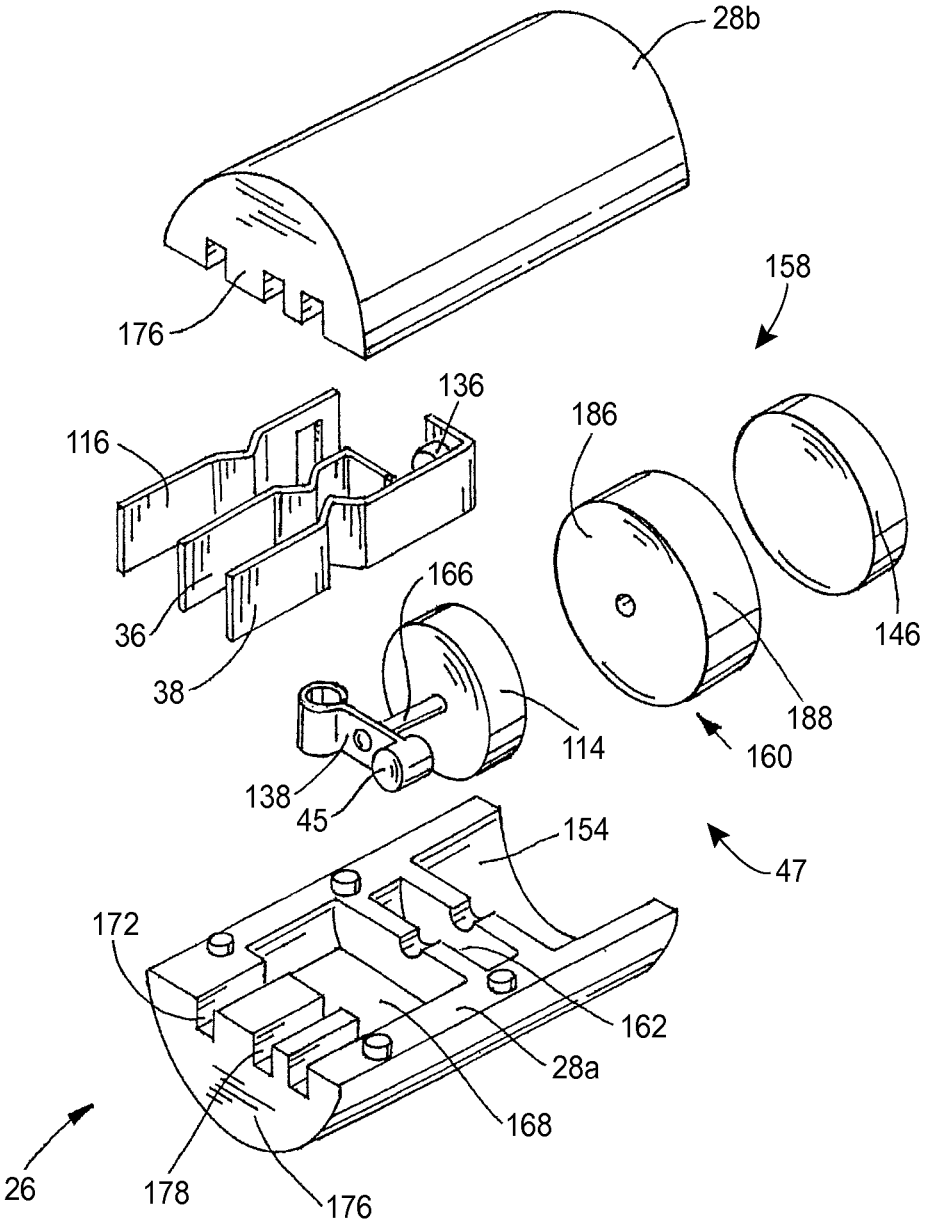
FIG. 4 is an exploded perspective view of an embodiment of a magnetically-triggered proximity switch.

As illustrated in FIG. 4, a semi-cylindrical first magnet cavity 162 may also be formed in the first body half 28*a* to receive and secure a stationary first magnet 114 within the body 28 such that a longitudinal axis of the disk-shaped first magnet 114 is substantially aligned with the body longitudinal axis 30 of the first body half 28*a*. Referring to FIG. 6, a semi-cylindrical upper arm cavity 164 may extend along the body longitudinal axis 30 between the second magnet cavity 154 and the first magnet cavity 162, and the upper arm cavity 164 may be sized to receive an elongated actuator arm 166 (illustrated in FIG. 4) that extends between the a pivotable cross-arm 138 and the magnet base 160, with the actuator arm 166, the cross-arm 138, and the detector magnet assembly 158 at least partially comprising the switching assembly 47. As illustrated in FIG. 3A, a generally cylindrical contact cavity 168 may be formed in the first body half 28*a* to receive a second end 44*c* of a common member 116, the second end 44*a* of the first contact member 36 (also called the primary arm), the second end 44*b* of the second contact member 38 (also called the secondary arm), the cross arm 138, and a first end 117 of the actuator arm 66. As illustrated in FIG. 6, a semi-cylindrical lower arm cavity 170 may extend along the body longitudinal axis 30 between the first magnet cavity 162 and the contact cavity 168, and the lower arm cavity 170 may be sized to receive the actuator arm 166. A rectangular common slot 172 may extend from the contact cavity 168 to the second end 34 of the first body half 28*a* in a direction generally parallel to the body longitudinal axis 30 such that the common slot 172 forms a common aperture 175 in a rear face 176 of the first body half 28*a* (illustrated in FIG. 3A). The common slot 172 may be sized to receive the common member 116 such that the first end 42*c* of the common member 116 extends through the common aperture 175 formed in the rear face 176. A rectangular primary slot 178 may extend from the contact cavity 168 to the second end 34 of the first body half 28*a* in a direction generally parallel to and offset from the common slot 172 such that the primary slot 178 forms a primary aperture 180 in the rear face 76 of the first body half 28*a*. The primary slot 178 may be sized to receive the primary arm 36 such that the first end 42*a* of the primary arm 36 extends through the primary aperture 180 in the rear face 176. In addition, a rectangular secondary slot 182 may extend from the contact cavity 168 to the second end 34 of the first body half 28*a* in a direction generally parallel to and offset from both the common slot 172 and the primary slot 178 such that the secondary slot 182 forms a secondary aperture 184 in the rear face 176 of the first body half 28*a*. The secondary slot 182 may be sized to receive the secondary arm 38 such that the first end 42*b* of the secondary arm 38 extends through the secondary aperture 184 in the rear face 176.

As discussed above and as illustrated in FIGS. 3A and 4, the proximity switch 26 also includes the detector magnet assembly 158 slidably disposed within the second magnet cavity 154 of the first body half 28*a* and the second body half 28*b* of the switch body 28. The detector magnet assembly 158 may include the second magnet 146, also called a detector magnet, that may be cylindrical in shape. Preferably, the second magnet 146 has the shape of a disk. The second magnet 146 may be a permanent magnet or any other type of suitable magnet. As illustrated in FIG. 4, the detector magnet assembly 158 may also include the magnet base 160 that may have a planar bottom portion 186 and a circumferential side wall 188 that extends away from the bottom portion 186. The bottom portion 186 and side wall 188 may be dimensioned to receive the second magnet 146 such that a planar surface of the second magnet 146 is proximate to the top of the side wall 188 and the outside radius of the second magnet 146 is slightly less than the inner radius of the side wall 188. The magnet base 160 may be made from a metal, such as stainless steel, and the second magnet 146 may be secured to the magnet base 160 by a magnetic force. Alternatively, the magnet base 160 may be made from a non-magnetic material, and the second magnet 146 may be mechanically or adhesively secured to the magnet base 160.

Referring again to FIGS. 3A and 4, the proximity switch 26 further includes the first magnet 114, also called a bias magnet. The first magnet 114 may be cylindrical in shape, and may have the shape of a disk. Referring to FIG. 3A, the first magnet 114 may also have an aperture 190 formed along the central longitudinal axis of the first magnet 114, and the aperture 190 may be sized to receive the actuator arm 166. The first magnet 114 may be received into the first magnet cavity 162 of the switch body 28 such that the first magnet 114 cannot displace when the first body half 28*a* and the second body half 28*b* are joined together to form the switch body 28. The first magnet 114 may be made from the same material as the second magnet 146, but the radius and the thickness of the first magnet 114 may each be smaller than the respective radius and thickness of the second magnet 146. The first magnet 114 may be positioned within the first magnet cavity 162 such that the second magnet 146 is attracted towards the first magnet 114. That is, if a north pole of the second magnet 146 faces the second end 34 of the switch body 28, a south pole of the first magnet 114 is disposed facing the north pole of the second magnet 146. Conversely, if a south pole of the second magnet 146 faces the second end 34 of the switch body 28, a north pole of the first magnet 114 is disposed facing the south pole of the second magnet 146.

Figure 7A:
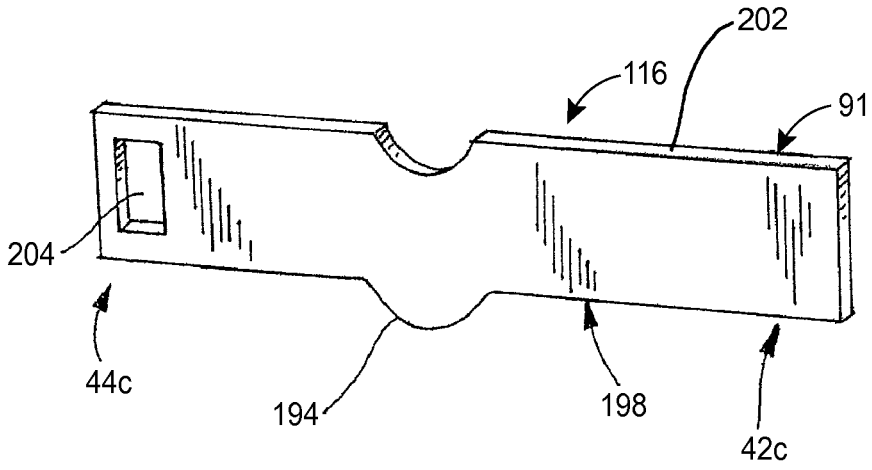
FIG. 7A is perspective view of a common member of an embodiment of a magnetically-triggered proximity switch.

Referring to FIGS. 3A, 4, and 7A, the proximity switch 26 also includes the common member 116, which is a common component of the circuit formed by the first switch position and the circuit formed by the second switch position. The common member 116 may be a narrow strip of a conducting metal, such as copper or a copper alloy, and the common member 116 may be formed from a stamping process. As discussed above, and as shown in FIG. 3A, the second end 44*c* of the common member 116 is disposed within the contact cavity 168 such that common member 116 extends through the common slot 172 formed in the switch body 28, and the first end 42*c* protrudes through the common aperture 175 to a position outside of the switch body 28. The common member 116 may be positioned within the common slot 172 such a longitudinal axis of the common member 116 is parallel to the body longitudinal axis 30 of the switch body 28 (illustrated in FIG. 6), while in a transverse direction, the common member 116 is perpendicular to the plane passing through the mating surface 151 of the first body half 28*a*. As illustrated in FIG. 3A, a rear surface 191 of the common member 116 may contact a first wall 192 of the common slot 172, the first wall 192 being longitudinally aligned with the common member 116 and perpendicular to the plane of the mating surface 151, as shown in FIG. 6. As illustrated in FIG. 3A, a portion of the common member 116 disposed within the common slot 172 may be curved, and a top surface of the curved portion 194 (see FIG. 7A) may contact a second wall 196 forming the common slot 172 (illustrated in FIG. 6), the second wall 196 being offset from and parallel to the first wall 192. Because the transverse distance between the top surface of the curved portion 194 (see FIG. 7A) and the rear surface 191 (see FIG. 3A) of the common member 116 is greater than the distance between the first wall 192 and second wall 196 of the common slot 172 (see FIG. 6), an interference fit is provided that secures the common member 116 within the common slot 172. As illustrated in FIG. 7A, a bottom surface 198 of the common member 116 may contact a third wall 200 (see FIG. 6) forming the common slot 172 of the first body half 28*a*, the third wall 200 being perpendicular to the first wall 192 and the second wall 196, and a top surface 202 (see FIG. 7A) of the common member 116 may contact a fourth wall (not shown) of the corresponding common slot 172 of the second body half 28*b* when the first body half 28*a* and the second body half 28*b* are assembled into the switch body 28. Because the third wall 200 of the common slot 172 is closer to the plane formed by the mating surface 151 than a bottom surface 201 of the contact cavity 168 (illustrated in FIG. 3A), a gap exists between the bottom surface 198 of the common member 116 (see FIG. 7A) and the bottom surface of the contact cavity 168 of the first body half 28*a*. Similarly, a gap exists between the top surface 202 of the common member 116 and the top surface (not shown) of the contact cavity 168 of the second body half 28*b*. As illustrated in FIG. 7A, the common member 116 may also include a transverse slot 204 that extends across the width of the common member 116 proximate to the second end 44*c*.

Referring to FIGS. 3A and 4, the proximity switch 26 also includes the first contact member 36 (also called the primary arm). The primary arm 36 may be made from the same material as the common member 116, and as illustrated in FIG. 3A, the primary arm 36 may engage the primary slot 178 in the same manner that the common member 116 engages the common slot 172. Accordingly, a curved portion 206 of the primary arm 36 provides an interference fit within the primary slot 178 to retain the primary arm 36 within the primary slot 178. In addition, the first end 42*a* of the primary arm 36 extends from the primary aperture 180 formed in the rear face 176 of the switch body 28 such that when viewed normal to the mating surface 151, the first end 42*a* of the primary arm 36 is parallel to the first end 42*c* of the common member 116. The primary arm 36 also includes a primary contact 128 disposed at the second end 44*a* of the primary arm 36. The primary contact 128 may be made from a conductive metal, such as copper or a copper alloy, and the primary contact 128 may be secured to the primary arm 36 in any manner known in the art, such as soldering or mechanical fastening. Alternatively, the primary contact 128 may be integrally formed with the second end 44*a* of the primary arm 36. The primary contact 128 may be disposed proximate to a first cavity wall 208 that partially defines the contact cavity 168.

Referring again to FIGS. 3A and 4, the proximity switch 26 includes the second contact member 38 (also called the secondary arm). The secondary arm 38 may be made from the same material as the common member 116, and the secondary arm 38 may engage the secondary slot 182 in the same manner that the common member 116 engages the common slot 172. However, the secondary arm 38 may be positioned within the secondary slot 182 in a "mirror image" relationship with the primary arm 36 in the primary slot 178. More specifically, as illustrated in FIG. 3A, a top surface of the curved portion 210 of the secondary arm 138 may face a top surface of the curved portion 206 of the primary arm 36. As configured, the first end 42*b* of the secondary arm 38 extends from the secondary aperture 184 formed in the rear face 176 of the switch body 28 such that when viewed normal to the mating surface 151, the first end 42*b* of the secondary arm 38 is parallel to both the first end 42*a* of the primary arm 36 and the first end 42*c* of the common member 116. The secondary arm 38 also includes a secondary contact 136 disposed at the second end 44*b* of the secondary arm 38. Similar to the primary contact 128, the secondary contact 136 may be made from a conductive metal, such as copper or a copper alloy, and the secondary contact 136 may be secured to the secondary arm 38 in any manner known in the art, such as soldering or mechanical fastening. Alternatively, the secondary contact 136 may be integrally formed with the second end 44*b* of the secondary arm 38. The secondary contact 136 may be disposed proximate to a second cavity wall 212 (see FIG. 6) of the contact cavity 168 that is offset from and parallel to the first cavity wall 208.

Figure 7B:
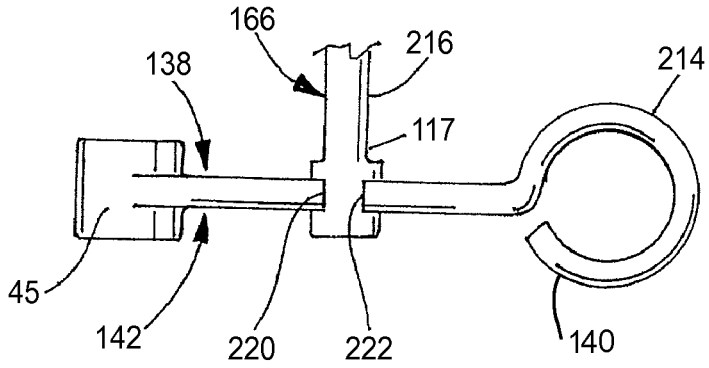
FIG. 7B is perspective view of a cross arm of an embodiment of a magnetically-triggered proximity switch.

Referring to FIGS. 3A, 4, and 7B, the proximity switch 26 also includes the cross arm 138 that is part of the displaceable switching assembly 47. The cross arm 38 may be formed from a narrow strip of a conducting metal, such as copper or a copper alloy, and the cross arm 138 may be formed from a stamping process and subsequent bending process. As illustrated in FIG. 7B, a second end 142 of the cross arm 138 may include a common contact 45. The common contact 45 may be made from a conductive metal, such as copper or a copper alloy, and the common contact 45 may be secured to the cross arm 138 in any manner known in the art, such as soldering or mechanical fastening. Alternatively, the common contact 45 may be integrally formed with the second end 142 of the cross arm 138. A first end 140 of the cross arm 138 may include an end loop 214, and a portion of the end loop 214 may be disposed within the transverse slot 204 of the common member 116 such that the cross arm 138 may rotate about the second end 44*c* of the common member 116 while maintaining contact with the common member 116. The cross arm 138 may be rotatable about the second end 44*c* of the common member 116 between the first switch position and the second switch position. In the first switch position, shown in FIG. 8A, the common contact 45 of the cross arm 138 is in contact with the primary contact 128 of the primary arm 36, thereby completing a circuit between the common member 116 and the primary arm 36. In the second switch position, shown in FIG.

8B, the common contact 45 of the cross arm 138 is in contact with the secondary contact 136 of the secondary arm 38, thereby completing a circuit between the common member 116 and the secondary arm 38.

Referring again to FIGS. 3A, 4, and 7B, the proximity switch 26 also includes the actuator arm 166 that is part of the displaceable switching assembly 47. As illustrated in FIG. 3A, the actuator arm 166 may be an elongated cylinder having a first end 117 and a second end 218 opposite the first end 117. Instead of a cylinder, the actuator arm 166 hay have any suitable cross-sectional shape or combination of shapes, such as that of a square, oval, or polygon. The actuator arm 166 may be formed from a plastic material or any other suitable material. The actuator arm 166 may be slidably disposed in the upper arm cavity 164 (see FIG. 6) and the lower arm cavity 170 (see FIG. 6) of the switch body 28, and each of the upper arm cavity 164 and the lower arm cavity 170 may have an inner diameter that is slightly greater than the outer diameter of the actuator arm 166. As illustrated in FIG. 3A, the actuator arm 166 may also extend through the aperture 190 in the first magnet 114 when the first magnet 114 is disposed within the first magnet cavity 162. As illustrated in FIG. 7B, the first end 117 of the actuator arm 166 may include a groove 220, and the groove 220 may receive an edge portion 222 that defines the aperture in the cross arm 138 to secure the actuator arm 166 to the cross arm 138. However, the first end 117 may be coupled to the cross arm 138 by any means known in the art, such as, for example, mechanical fastening. The second end 218 of the actuator arm 166 may be coupled to the magnet base 160 of the detector magnet assembly 158 in a manner similar to the coupling of the first end 117 to the cross arm 138.

In operation, the first magnet 114 provides a magnetic force that attracts the second magnet 146. This attractive force displaces the detector magnet assembly 158 towards the first magnet 114, thereby displacing the actuator arm 166 towards the second end 34 of the switch body 28. The displacement of the actuator arm 166 rotates the cross arm 138 about the second end 44*c* of the common member 116 such that the common contact 45 is in contact with the primary contact 128. In this first switch position, shown in FIG. 8A, a circuit is completed between the primary arm 36 and the common member 116 (i.e., the primary arm 36 is electrically coupled to the common member 116). Accordingly, the closed circuit that results from the first switch position can be detected by a processor that is operatively connected to the first end 42*c* of the common member 116 (via a third pin 48*c* of the external connection assembly 46) and the first end 42*a* of the primary arm 36 (via the first pin 48*a* of the external connection assembly 46).

However, when a magnetic target 224, which may include a permanent magnet or a ferrous metal, is moved into a position within a predetermined range of the proximity switch 26 disposed within the housing 12, the magnetic force between the target 224 and the second magnet 146 may be greater than the magnetic force between the second magnet 146 and the first magnet 114. The greater force displaces the detector magnet assembly 158 towards the target 224 and away from the first magnet 114, thereby displacing the actuator arm 166 that is rigidly coupled to the magnet base 160 of the detector magnet assembly 158. As the actuator arm 166 is displaced, the cross arm 138 is rotated about the second end 44*c* of the common member 116 to move the common contact 45 out of contact with the primary contact 128 and into contact with the secondary contact 136. In this second switch position, shown in FIG. 8B, a circuit is completed between the secondary arm 38 and the common member 116 (i.e., the secondary arm 38 is electrically coupled to the common member 116).

Accordingly, the closed circuit that results from the second switch position can be detected by a processor that is operatively connected to the first end 42*c* of the common member 116 (via the third pin 48*c* of the external connection assembly 46) and the first end 42*b* of the secondary arm 38 (via the second pin 48*b* of the external connection assembly 46). When the target 224 is no longer within the predetermined range of the proximity switch 26 disposed within the housing 12, the magnetic force between the first magnet 114 and the second magnet 146 becomes greater than the magnetic force between the second magnet 146 and the target 224, and the proximity switch 26 moves into the first position in the manner described above.

One having ordinary skill in the art would recognize that the magnetic force between the target 224 and the second magnet 146 can depend on several factors, such as the relative size of the target 224 and the second magnet 146 and the distance between the target 224 and the second magnet 146, and these variables can be adjusted to provide for optimal interaction between the proximity switch 26 and the target 224. In a similar manner the magnetic force between the second magnet 146 and the first magnet 114 can also be adjusted.

Additional embodiments of the proximity switch are also contemplated. For example, an embodiment a magnetically-triggered proximity switch 300 is illustrated in FIGS. 10A to 12B. Referring to FIGS. 10A, 10B, 11B, 12A and 12B, the proximity switch 300 includes a cylindrical switch body 302 (made up of two switch body halves 302*a*, 302*b*) extending along a body longitudinal axis 304, the switch body 302 having a first end 306 disposed adjacent to the first end 16 of the housing 12 and a longitudinally-opposite second end 308. A cylindrical sleeve 309 may surround the switch body 302, and the sleeve 309 may have a closed end adjacent to the first end 306 of the switch body 302 and an open end adjacent to the second end 308 of the switch body 302. The proximity switch 300 includes an elongated first contact member 310 having a first end 312 and a longitudinally-opposite second end 314. The second end 314 may be disposed within the switch body 302 and the first end 312 may be disposed external to the switch body 302. That is, a portion of the first contact member 310 may extend from the second end 308 of the switch body 302 towards the second end 18 of the housing 12. The proximity switch 300 also includes an elongated second contact member 316 having a first end 318 and a longitudinally-opposite second end 320. The second end 320 may be disposed within the switch body 302 and the first end 318 may be disposed external to the switch body 302. That is, a portion of the second contact member 310 may extend from the second end 308 of the switch body 302 towards the second end 18 of the housing 12.

Still referring to FIGS. 10A, 10B, 11B, 12A and 12B, the proximity switch 300 further includes an elongated third contact member 322 having a first end 324 and a longitudinally-opposite second end 326. The second end 326 may be disposed within the switch body 302 and the first end 324 may be disposed external to the switch body 302. That is, a portion of the third contact member 322 may extend from the second end 308 of the switch body 302 towards the second end 18 of the housing 12. The first contact member 310 and the third contact member 322 may be aligned such that the second end 314, 326 of each of the first contact member 310 and the third contact member 322 extend an identical first longitudinal distance from an end surface 328 of the switch body 302.

The proximity switch 300 additionally includes an elongated forth contact member 330 having a first end 332 and a longitudinally-opposite second end 334. The second end 334 may be disposed within the switch body 302 and the first end 332 may be disposed external to the switch body 302. That is, a portion of the forth contact member 330 may extend from the second end 308 of the switch body 302 towards the second end 18 of the housing 12. The second contact member 316 and the forth contact member 330 may be aligned such that the second end 320, 334 of each of the second contact member 316 and the forth contact member 330 extend an identical second longitudinal distance from the end surface 328 of the switch body 302, and that second longitudinal distance may be greater than the first longitudinal distance.

Figure 10A:
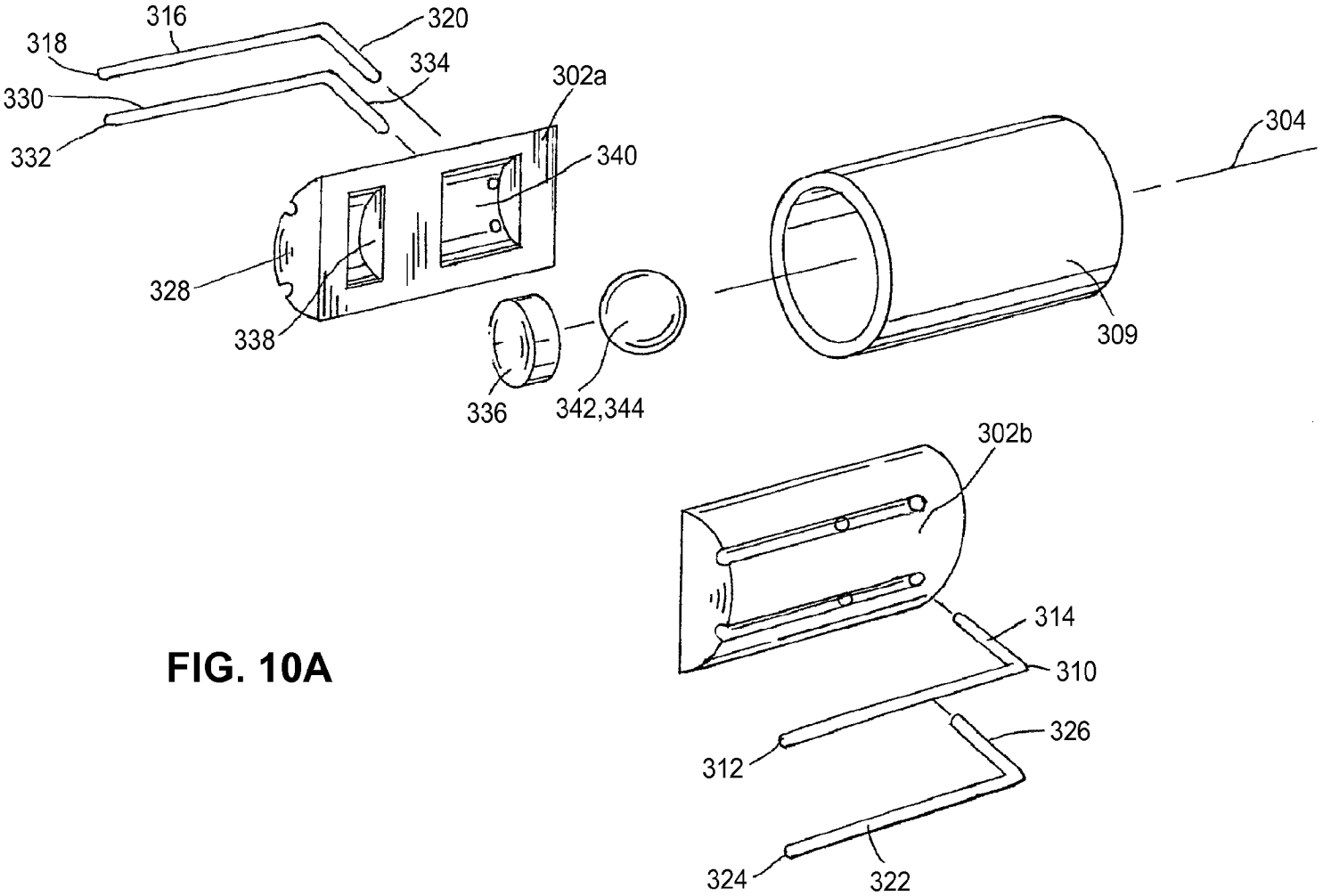
FIG. 10A is an exploded perspective view of an embodiment of a magnetically-triggered proximity switch.
Figure 10B:
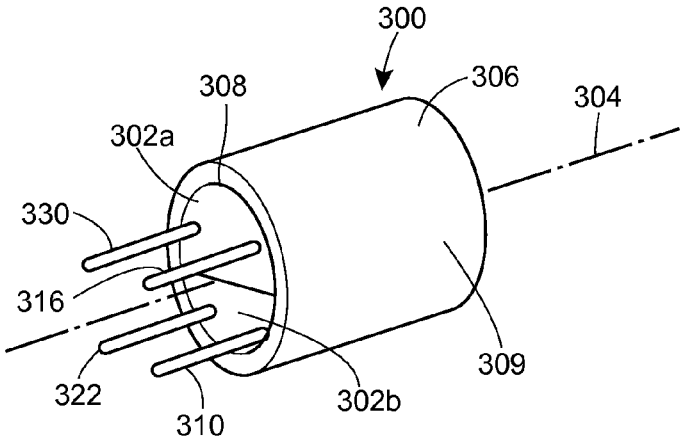
FIG. 10B is a perspective view of the embodiment of FIG. 10A.
Figure 11A:
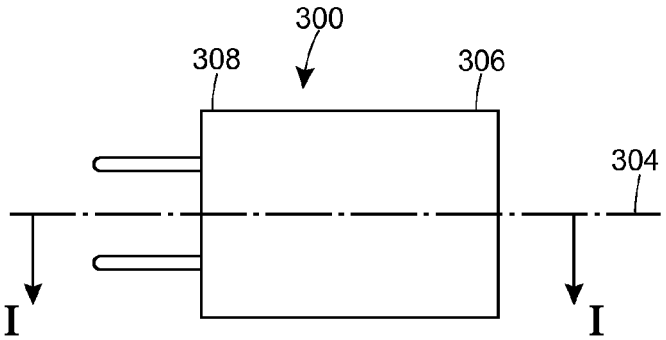
FIG. 11A is a side view of the embodiment of FIG. 10A.
Figure 11B:
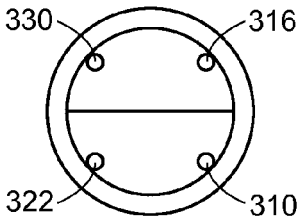
FIG. 11B is a rear view of the embodiment of FIG. 10A.
Figure 12A:
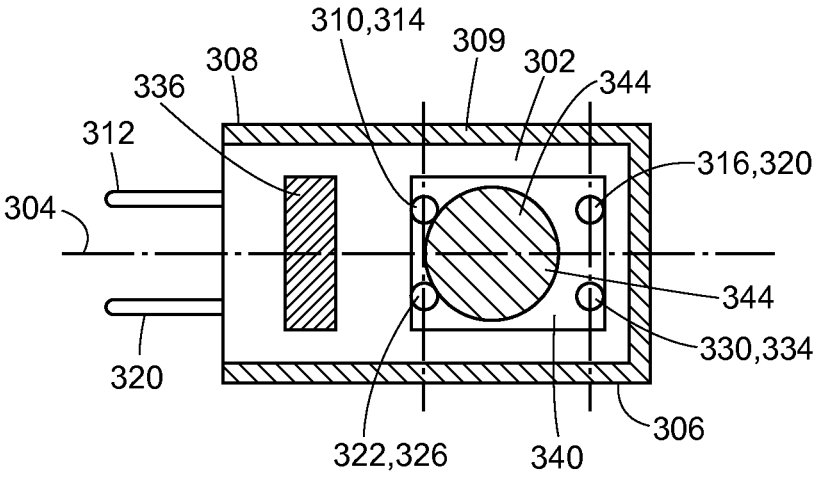
FIG. 12A is a sectional view of the embodiment of FIG. 11A taken along line I illustrating the magnetically-triggered proximity switch in a first switch position.
Figure 12B:
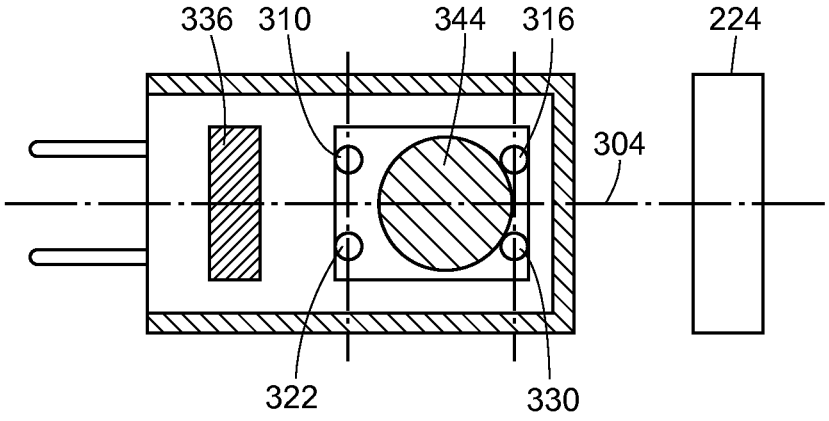
FIG. 12B is a sectional view of the embodiment of FIG. 11A taken along line I illustrating the magnetically-triggered proximity switch in a second switch position.

Referring to FIGS. 10A, 12A, and 12B The proximity switch 300 may also include a stationary first magnet 336 that may be disposed within a first cavity 338 formed in the switch body 302, and the stationary first magnet 336 may have the shape of a disk. The second ends 314, 320, 326, 334 of each of the first, second, third, and forth contact members 310, 316, 322, 330 may be disposed within an elongated cylindrical second cavity 340 formed in the switch body 302. The proximity switch 300 may also include a displaceable switching assembly 342 comprising a spherical, displaceable second magnet 344 that may longitudinally displace within the second cavity 340. In a first switch position (illustrated in FIG. 12A), the displaceable second magnet 344 is in contact with a portion of the first contact member 310. More specifically, the displaceable second magnet 344 is biased by the stationary first magnet 336 to be in contact with a portion of the second end 314 of the first contact member 310 and a portion of the second end 326 of the third contact member 322 to electrically couple the first contact member 310 to the third contact member 322. Accordingly, the closed circuit that results from the first switch position can be detected by a processor that is operatively connected to the first end 312 of the first contact member 310 (via a first pin 48*a* of the external connection assembly 46) and the first end 324 of the third contact member 322 (via the third pin 48*c* of the external connection assembly 46).

As illustrated in FIG. 12B, when a magnetic target 224, which may include a permanent magnet or a ferrous metal, is moved into a position within a predetermined range of the proximity switch 300 disposed within the housing 12, the magnetic force between the target 224 and the second magnet 344 may be greater than the magnetic force between the second magnet 344 and the first magnet 336. The greater force displaces the second magnet 344 towards the target 224 and away from the first magnet 344 and into a second switch position (illustrated in FIG. 12B). In the second switch position, the displaceable second magnet 344 is in contact with a portion of the second contact member 316. More specifically, the displaceable second magnet 344 is in contact with a portion of the second end 320 of the second contact member 316 and a portion of the second end 334 of the forth contact member 330 to electrically couple the second contact member 316 to the forth contact member 330. Accordingly, the closed circuit that results from the second switch position can be detected by a processor that is operatively connected to the first end 318 of the second contact member 316 (via the second pin 48*b* of the external connection assembly 46) and the first end 332 of the forth contact member 330 (via the forth pin 48*d* of the external connection assembly 46).

One having ordinary skill in the art would also recognize that the disclosed embodiments of the magnetically-triggered proximity switch 26, 300 allow for a relatively small switch body having an integrated design, which further allows the proximity switch 26, 300 to be used in applications with limited space requirements, such as in electrical junction boxes. It is also apparent to one having ordinary skill in the art that the disclosed embodiments of the proximity switch 26, 300 unlike typical proximity switches, do not need an external power source to function, thereby simplifying installation and extending the working life of the proximity switch 26, 300.

Figure 1B:
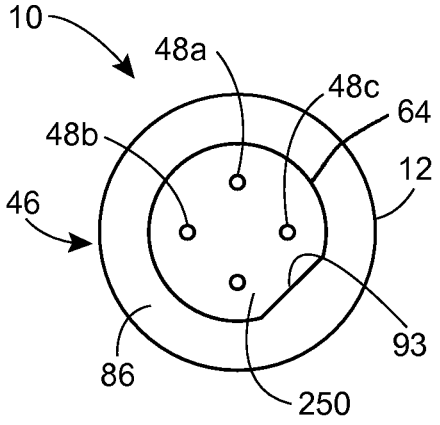
FIG. 1B is an isometric view of the embodiment of FIG. 1A.
Figure 1C:
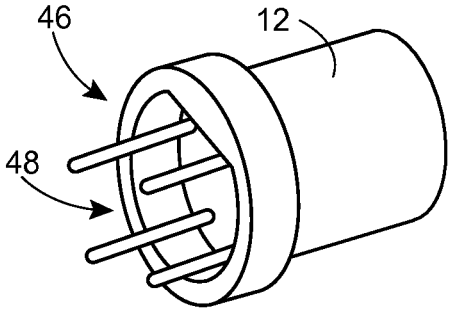
FIG. 1C is a front view of the embodiment of FIG. 1A.

As illustrated in FIGS. 1A, 1B, and 1C, the quick-disconnect connector assembly 10 also includes the external connection assembly 46, and the external connection assembly 46 and the second end 18 of the housing 12 cooperate to form a male socket that is adapted to removably receive the plug 280 (see FIG. 9A) that will be described in more detail. As illustrated in Figure A, the external connection assembly 46 includes a plurality of pins 48, and at least a portion of each of the plurality of pins 48 may be disposed within the bore 22. More specifically, the external connection assembly 46 includes the first pin 48*a* that is electrically coupled to the first contact member (the primary arm 36) and the second pin 48*b* that is electrically coupled to the second contact member (the secondary arm 38). The external connection assembly 46 may also include a third pin 48*c* that is electrically coupled to the common member 116. In addition, the external connection assembly 46 may include one or more additional pins that may be electrically coupled to desired features of the proximity switch 26 to, for example, provide power or act as ground, such as a fourth pin 48*d*. Each of the plurality of pins 48 may be adapted to be received into corresponding slots or receptacles of a standard female plug (e.g., the plug 280 illustrated in FIGS. 9A and 9B) that is coupled to a controller and/or processor to determine, for example, whether the proximity switch 26 is in the first switch position or the second switch position.

As illustrated in FIG. 1A, each of the plurality of pins 48 may longitudinally extend from a first insulator 250 that may be disposed within the bore 22. The first insulator 250 may be disposed within the second bore portion 62 (see FIG. 2), and a side surface 252 of the first insulator 250 may have a cross-sectional shape that is identical to, but slightly inwardly-offset from, the cross-sectional shape of the second interior wall 70 (see FIG. 2) of the second bore portion 62. More specifically, the side surface 252 of the first insulator 250 may be cylindrical and may be slightly offset from the cylindrical second interior wall 70, and a longitudinal axis of the first insulator 250 may be coaxial with the longitudinal axis 14 of the housing 12. A first end surface 254 may extend normal to the longitudinal axis of the first insulator 250 at a first end of the first insulator 250, and the first end surface 254 may be planar. A second end surface 256 may be disposed at the second end of the first insulator 250 and may be parallel to the first end surface 254. The first end surface 254 may be aligned with or substantially aligned with the radial surface of the bore 22 that comprises the shoulder portion 82 (see FIG. 2) at the top end 80 of the second bore portion 62.

Still referring to FIG. 1A, the second end surface 256 may be immediately adjacent to (or slightly offset from) a first end surface 258 of a second insulator 260 that may be disposed within the second bore portion 62, and the first end surface 258 may be disposed at a first end of the second insulator 260. The second insulator 260 may be identical or substantially identical to the first insulator 250, and the second insulator 260 may have a longitudinal axis that is coaxial with the longitudinal axis 14 of the housing 12. A planar second end surface 262 may be disposed at a second end of the second insulator 260, and the first end surface 258 may be parallel to the second end surface 262. The second end surface 262 may be aligned with or substantially aligned with the radial surface of the bore 22 that comprises the shoulder portion 74 (see FIG. 2) at the bottom end 74 of the second bore portion 62. A gap may exist between each of the side surface 252 of the first insulator 250 and a side surface 264 of the second insulator 260 and the second interior wall 70 of the second bore portion 62. This gap may be filled with a sealant or adhesive to prevent debris or other contaminants from entering the first and second bore portions 24, 62. A planar end plate (not shown) may be disposed adjacent to or in contact with the first end surface 254 of the first insulator 250, and the end plate may be secured to the shoulder portion 82 (see FIG. 2) or the third interior wall 78 of the housing 12 to prevent debris or other contaminants from entering the first and second bore portions 24, 62, and each of the plurality of pins 48 may be integrally formed with (or extend through apertures formed in) the end plate. While the first and second insulators 250, 260 are shown, any number of insulators may be used. In addition, no insulators may be used. The insulators may be made from any suitable material having low electrical conductivity, such as a plastic material.

As illustrated in FIG. 1A, a plurality of conductive passageways 266 (represented as dotted lines in FIG. 1A) may extend through each of the first and second insulators 250, 260. Specifically, a first conductive passageway 266*a* may connect the first contact member 36 to the first pin 48*a*, a second conductive passageway 266*b* may connect the second contact member 38 to the second pin 48*b*, and a third conductive passageway 266*c* may connect the common member 116 to the third pin 48*c*. Additional conductive passageways may be provided to connect additional portions of the proximity switch 26 to corresponding pins, such as the fourth pin 48*d*.

Still referring to FIG. 1A, a first end of the first conductive passageway 266*a* may be configured to receive a portion of the first contact member 36 (i.e., a portion adjacent to the first end 42*a* of the first contact member 36), and a second end of the first conductive passageway 266*a* may be configured to receive (or be connected to) a portion of the first pin 48*a* such that an electrical current originating in the first contact member 36 is conducted to the first pin 48*a*. A first end of the second conductive passageway 266*b* may be configured to receive a portion of the second contact member 38 (i.e., a portion adjacent to the first end 42*b* of the second contact member 38), and a second end of the second conductive passageway 266*b* may be configured to receive (or be connected to) a portion of the second pin 48*b* such that an electrical current originating in the second contact member 38 is conducted to the second pin 48*b*. A first end of the third conductive passageway 266*c* may be configured to receive a portion of the common member 116 (i.e., a portion adjacent to the first end 42*c* of the common member 116), and a second end of the third conductive passageway 266*c* may be configured to receive (or be connected to) a portion of the third pin 48*c* such that an electrical current originating in the common member 116 is conducted to the third pin 48*c*. Each of the plurality of conductive passageways 266 may comprise one or more conductive components, and any suitable conductive material or combination of materials may be used.

A first end of fourth conductive passageway (not shown) may be configured to be connected to a desired portion of the proximity switch 26 or housing 12 and a second end of the fourth conductive passageway may be configured to receive (or be connected to) a portion of the fourth pin 48*d* such that an electrical current originating in the desired portion of the proximity switch 26 or the housing 12 is conducted to the fourth pin 48*d*.

Each of the plurality of conductive passageways 266 may include a lead or wire that is secured to a receiving member that is adapted to be coupled to a corresponding pin 48 and to a corresponding one of the first contact member 36, second contact member 38, and/or common member 116. Alternatively, a lead or wire may be directly secured to (e.g., by soldering) a corresponding pin 48 and to a corresponding one of the first contact member 36, second contact member 38, and/or common member 116.

Each of the plurality of pins 48 may longitudinally extend from (or from a point adjacent to) the first end surface 254 of the first insulator 250 to a point between the top end 88 and the bottom end 84 of the third interior wall 78 of the third bore portion 64. The plurality of pins 48 may be arrayed in any suitable arrangement that may correspond to the slots or receptacles of a standard plug 280 (illustrated in FIG. 9A) that is coupled to a controller and/or processor to determine, for example, whether the proximity switch 26 is in the first switch position or the second switch position. For example, the plurality of pins 48 may be arrayed at 90° intervals an equal radial distance from the longitudinal axis 14, as illustrated in FIG. 1B.

The quick-disconnect connector assembly 10 may be adapted to operate in harsh or extreme conditions. Specifically, the second end 18 of the housing 12 may be sealed (e.g., hermetically sealed) such that no gaps exist between the first insulator 250 and the bore 22. Such a seal may be achieved by an interference fit between the first insulator 250 and the bore 22 or by inserting a sealant between the side surface 252 of the first insulator 250 and the a portion of the bore 22, such as the second interior wall 70. In addition, the previously-discussed planar end plate (not shown) or any other suitable cap or plug may be secured to a portion of the housing 12 to prevent debris or other contaminants from entering the first and/or second bore portions 24, 62. Sealed as described, the quick-disconnect connector assembly 10 is suitable for use in hazardous environments and/or may be permanently submersible. In addition, the use of suitable high-temperature materials would allow for use in nuclear applications.

Configured as described, the quick-disconnect connector assembly 10 can be used as a position sensor secured to a first object to detect relative movement of a target secured to a second object. The quick-disconnect connector assembly 10 can therefore be used as a position sensor in a variety of application in which relative movement is to be detected, such as in valve and actuator applications, nuclear applications (i.e., determining the position of fuel rods), and in machine applications (i.e., to determine a crane position). For example, as illustrated in FIG. 9A, a control valve 267 may include a valve housing 268, and the valve housing 268 may include an inlet 270, an outlet 272, and a valve seat 271 disposed between the inlet 270 and the outlet 272. A bonnet 273 may be secured to a top portion of the valve housing 268. A valve member 276 may be disposed at a first end of a valve stem 274, and the valve stem 274 may extend through or be surrounded by a portion of the valve housing 268 or the bonnet 273. The valve stem 274 and the valve member 276 may be longitudinally-displaced by an actuator (not shown) from a first position (an open position illustrated in FIG. 9A) in which process fluid flows from the inlet 270 to the outlet 272 to a second position (a closed position illustrated in FIG. 9B) in which the valve member 276 prevents process fluid from flowing from the inlet 270 to the outlet 272. The quick-disconnect connector assembly 10 may be secured to a portion of valve housing 268 (such as portion of the valve housing 268 surrounding the valve stem 274, or a bracket secured to the valve housing 268) by rotating the housing 12 such that the threaded portion 58 engages a threaded bore formed in the valve housing 268. As such, the longitudinal axis 14 of the housing 12 may be normal to a longitudinal axis of the valve stem 274 and the first end 16 of the housing 12. In addition, a magnetic target 224 may be secured to the valve stem 274. The plug 280 may be secured to the second end 18 of the housing 12 in the manner previously described, and the plug 280 may be operatively coupled to a processor 282 by one or more communication lines 284.

When the control valve 267 is in the first position, the target 224 is not within a predetermined range of the proximity switch 26 disposed within the housing 12. Accordingly, the magnetic force between the first magnet 114 and the second magnet 146 of the proximity switch 26 is greater than the magnetic force between the second magnet 146 and the target 224, and the proximity switch 26 is in the first switch position (illustrated in FIG. 8A). Consequently, a circuit is completed between the primary arm 36 and the common member 116, and the closed circuit that results from the first switch position can be detected by the processor 282 that is operatively connected to the first end 42*c* of the common member 116 (via a third pin 48*c* of the external connection assembly 46) and the first end 42*a* of the primary arm 36 (via the first pin 48*a* of the external connection assembly 46).

However, when the control valve 267 is in the second position (due to an emergency shut-down condition, for example), the magnetic target 224 is moved into a position within a predetermined range of the proximity switch 26 disposed within the housing 12. Consequently, the magnetic force between the target 224 and the second magnet 146 becomes greater than the magnetic force between the second magnet 146 and the first magnet 114. The greater force displaces the cross-arm 138 of the switching assembly 47 into the second switch position (shown in FIG. 8B). The closed circuit that results from the second switch position can be detected by the processor 282 that is operatively connected to the first end 42*c* of the common member 116 (via the third pin 48*c* of the external connection assembly 46) and the first end 42*b* of the secondary arm 38 (via the second pin 48*b* of the external connection assembly 46).

As previously discussed, the quick-disconnect connector assembly 10 reduces the number of components used in conventional sensor assemblies, allowing for the elimination of a separate housing for the proximity switch 26. In addition, the proximity switch 26 may also include a magnetically-actuated displaceable switching assembly 47, and such a mechanism allows for an overall reduction in the size of the proximity switch 12, further allowing for a reduction in the size of the housing 12 that contains the proximity switch 26.

Variations can be made to the disclosed embodiments of the proximity switch 26 that are still within the scope of the appended claims. For example, instead of the single pole/single throw configuration described, a double pole/double throw configuration is also contemplated. In addition, LEDS may be included in the housing to visually indicate whether the proximity switch is in the first switch position or the second switch position.

What is claimed is:

1. A quick-disconnect connector assembly comprising:

a housing that extends along a longitudinal axis from a first end to a longitudinally-opposite second end, the housing including one or more interior surfaces that cooperate to define a bore that extends from the second end to a point adjacent to the first end such that the bore does not extend through the first end of the housing, wherein the bore includes a first bore portion; and a proximity switch disposed within the first bore portion, the proximity switch comprising:

a switch body extending along a body longitudinal axis, the switch body having a first end disposed adjacent to the first end of the housing and a longitudinally-opposite second end; and a first contact member and a second contact member, each of the first and second contact members having a first end and a longitudinally-opposite second end, the second end being disposed within the switch body and the first end being disposed external to the switch body, wherein a portion of each of the first and second contact members extends from the second end of the switch body towards the second end of the housing, wherein in a first switch position, a contact of a displaceable switching assembly is in contact with a portion of the first contact member, and in a second switch position, the contact of the switching assembly is in contact with a portion of the second contact member; and an external connection assembly including a first pin that is electrically coupled to the first contact member and a second pin that is electrically coupled to the second contact member, wherein the first pin and the second pin each extend in a longitudinal direction, and wherein at least a portion of each of the first pin and the second pin are disposed within the bore.

2. The quick-disconnect assembly of claim 1, the proximity switch further comprising a common member having a first end and a longitudinally-opposite second end, the second end being disposed within the switch body and the first end being disposed external to the switch body, wherein a portion of the common member extends from the second end of the switch body towards the second end of the housing, wherein in the first switch position, the first contact member is electrically coupled to the common member and in the second switch position, the second contact member is electrically coupled to the common member.

3. The quick-disconnect assembly of claim 1, the proximity switch further comprising a stationary first magnet disposed within the switch body, wherein the switching assembly includes a displaceable second magnet, wherein a magnetic target acting on the second magnet causes the switching assembly to move from the first switch position to the second switch position.

4. The quick-disconnect assembly of claim 3, the switching assembly further comprising a cross arm pivotably coupled to the common member and fixedly coupled to the second magnet, wherein the magnetic target acting on the second magnet causes the cross arm to pivot to move the switching assembly from the first switch position to the second switch position.

5. The quick-disconnect assembly of claim 3, wherein the displaceable second magnet has a spherical shape.

6. The quick-disconnect assembly of claim 5, wherein in the first switch position, the displaceable second magnet is in contact with the first contact member and a third contact member and in the second switch position, the displaceable second magnet is in contact with the second contact member and a fourth contact member.

7. The quick-disconnect assembly of claim 1, wherein the housing is symmetrically formed about the longitudinal axis.

8. The quick-disconnect assembly of claim 1, wherein the housing includes an intermediate point disposed between the first end and the second end.

9. The quick-disconnect assembly of claim 8, wherein the housing includes a first exterior portion that extends from the first end to the intermediate point and a second exterior portion that extends from the intermediate point to the second end.

10. The quick-disconnect assembly of claim 9, wherein the first exterior portion is cylindrical and the second exterior portion is cylindrical, and a diameter of the second exterior portion is larger than a diameter of the first exterior portion.

11. The quick-disconnect assembly of claim 1, wherein the longitudinal axis of the housing is coaxially aligned with the body longitudinal axis.

12. A system for detecting a position of a control valve, the system comprising:

a valve housing including an inlet, an outlet, and a valve seat disposed between the inlet and the outlet;

a displaceable valve member disposed at least partially within the valve housing, the valve member being displaceable between a closed position in which the valve member sealingly engages the valve seat and an open position in which the valve member is positioned away from the valve seat;

a magnetic target coupled to the valve member;

a quick-disconnect connector assembly fixed relative to the valve member, wherein the quick-disconnect connector assembly comprises:

a housing that extends along a longitudinal axis from a first end to a longitudinally-opposite second end, the housing including one or more interior surfaces that cooperate to define a bore that extends from the second end to a point adjacent to the first end such that the bore does not extend through the first end of the housing, wherein the bore includes a first bore portion;

a proximity switch disposed within the first bore portion, the proximity switch comprising:

a switch body extending along a body longitudinal axis, the switch body having a first end disposed adjacent to the first end of the housing and a longitudinally-opposite second end; and a first contact member and a second contact member, each of the first and second contact members having a first end and a longitudinally-opposite second end, the second end being disposed within the switch body and the first end being disposed external to the switch body, wherein a portion of each of the first and second contact members extends from the second end of the switch body towards the second end of the housing, wherein in a first switch position, a contact of a displaceable switching assembly is in contact with a portion of the first contact member, and in a second switch position, the contact of the switching assembly is in contact with a portion of the second contact member; and an external connection assembly including a first pin that is electrically coupled to the first contact member and a second pin that is electrically coupled to the second contact member, wherein the first pin and the second pin each extend in a longitudinal direction, and wherein at least a portion of each of the first pin and the second pin are disposed within the bore; and a controller operatively coupled to the first pin and the second pin.

13. The system of claim 12, further comprising a valve stem having a first end, wherein the valve member is disposed at the first end of the valve stem, and wherein the magnetic target is coupled to a valve stem.

14. The system of claim 12, wherein the quick-disconnect connector assembly is coupled to valve housing.

15. The system of claim 12, the proximity switch further comprising a common member having a first end and a longitudinally-opposite second end, the second end being disposed within the switch body and the first end being disposed external to the switch body, wherein a portion of the common member extends from the second end of the switch body towards the second end of the housing, wherein in the first switch position, the first contact member is electrically coupled to the common member and in the second switch position, the second contact member is electrically coupled to the common member.

16. The quick-disconnect assembly of claim 12, the proximity switch further comprising a stationary first magnet disposed within the switch body, wherein the switching assembly includes a displaceable second magnet, wherein a magnetic target acting on the second magnet causes the switching assembly to move from the first switch position to the second switch position.

17. The quick-disconnect assembly of claim 16, the switching assembly further comprising a cross arm pivotably coupled to the common member and fixedly coupled to the second magnet, wherein the magnetic target acting on the second magnet causes the cross arm to pivot to move the switching assembly from the first switch position to the second switch position.

18. The system of claim 12, wherein the housing includes a first exterior portion that extends from the first end to an intermediate point and a second exterior portion that extends from the intermediate point to the second end.

19. The quick-disconnect assembly of claim 18, wherein the first exterior portion is cylindrical and the second exterior portion is cylindrical, and a diameter of the second exterior portion is larger than a diameter of the first exterior portion.

20. The system of claim 12, wherein the longitudinal axis of the housing is coaxially aligned with the body longitudinal axis.

* * * * *